United States Patent [19]

Sillars

[11] Patent Number: 4,601,239

[45] Date of Patent: Jul. 22, 1986

[54] APPARATUS FOR PRINTING QUASI RANDOM NUMBER TABLES

[76] Inventor: Ian M. Sillars, 65A Pine St. (Lower), Cammeray, New South Wales 2062, Australia

[21] Appl. No.: 783,141

[22] Filed: Oct. 2, 1985

[30] Foreign Application Priority Data

Dec. 24, 1984 [AU] Australia ..... PG8714

[51] Int. Cl.[4] ..... B41J 45/00

[52] U.S. Cl. ..... 101/76; 101/142

[58] Field of Search ..... 101/76, 141–142, 101/70, 72, 74, 177, 219, 216, 426; 270/1.1, 18

[56] References Cited

U.S. PATENT DOCUMENTS

| | | | |
|---|---|---|---|
| 3,421,752 | 1/1969 | Folino | 101/72 |
| 3,768,801 | 10/1973 | Maynard et al. | 270/53 |
| 3,822,876 | 7/1974 | Frain | 101/426 |
| 3,998,446 | 12/1976 | Dent | 101/72 |
| 4,287,824 | 9/1981 | Boyle | 101/76 |
| 4,421,027 | 12/1983 | Fischer | 101/142 |
| 4,441,423 | 4/1984 | Germann | 101/177 |
| 4,444,103 | 4/1984 | Cronin | 101/72 |
| 4,470,348 | 9/1984 | Seeley et al. | 101/219 |
| 4,479,431 | 10/1984 | Germann | 101/141 X |
| 4,541,333 | 9/1985 | Sillars | 101/76 |

*Primary Examiner*—E. H. Eickholt

*Attorney, Agent, or Firm*—Dressler, Goldsmith, Shore, Sutker & Milnamow

[57] ABSTRACT

Apparatus for printing quasi random number tables used in games of chance comprising a flexographic printing press, such as a Victory Kidder Press, provided with a number of cylinders of different circumferences arrayed about a central drum. Each circumference is a multiple of a basic pitch value and each cylinder is arranged to print columns of numbers or other symbols alongside similar columns printed by the other cylinders in a quasi random array.

The tables may be printed on a large number of different materials such as; newspaper preprints, plastic film food wrappers, card, etc.

5 Claims, 5 Drawing Figures

10

| | | | | | |
|---|---|---|---|---|---|
| 34 $100 | 25 $500 | 4 $100 | 15 $500 | 11 $200 | 12 $300 |
| 2 $300 | 3 $400 | 24 $100 | 16 $1,000 | 30 $10,000 | 13 $400 |
| 19 $5,000 | 18 $3,000 | 32 $400 | 23 $400 | 31 $200 | 7 $2,000 |
| 27 $2,000 | 21 $200 | 35 $500 | 36 $1,000 | 1 $200 | 6 $1,000 |
| 9 $5,000 | 20 $10,000 | 28 $3,000 | 10 $10,000 | 17 $2,000 | 22 $300 |
| 26 $1,000 | 33 $400 | 5 $500 | 8 $3,000 | 14 $100 | 29 $5,000 |

10

APPARATUS FOR PRINTING QUASI RANDOM NUMBER TABLES

BACKGROUND OF THE INVENTION

This invention relates to apparatus for printing quasi random number tables and has been devised particularly though not solely for printing tables for games of chance.

It is well known to provide tables of apparently random numbers for use in playing games of chance, such as bingo or various other games requiring the selection of a number of "winning numbers" from a table of such numbers. Further adaptations of these games require a winning combination incorporating, for example, three numbers the same in a row or three "prizes" of the same value alongside three numbers drawn from a selection of such numbers and announced or otherwise published.

In fact these tables are seldom true random number tables but incorporate a very large number of variables which are eventually repeated after a large number of tables have been printed. To the end user, however, each table appears to incorporate a matrix of apparently random numbers and is referred to throughout this specification as a "quasi random number table".

It has also been known to use such tables in which "prizes" are covered by a silvered layer rendering the prize values invisible until the silver layer is scratched off. Such games are commonly called "scratch bingo games". It has been a disadvantage in the past that the cards of quasi random number tables incorporating silvered coatings used in scratch bingo games have been time consuming and difficult to print, requiring a number of printing runs and considerable handling and collating.

SUMMARY OF THE INVENTION

It is therefore an object of the present invention to provide apparatus for printing quasi random number tables which will obviate or minimise the foregoing disadvantages in a simple yet effective manner, or which will at least provide the public with a useful choice.

Accordingly the invention consists in apparatus for printing quasi-random number tables (as herein defined) comprising a flexographic printing press having at least two table printing cylinders arrayed about a central drum, said table printing cylinders having different circumferences, the circumference of each cylinder being a multiple of a basic pitch value, each one of the table printing cylinders being arranged to print at least one column of numbers incorporating a predetermined number of numbers therein different from the number of numbers printed in a column by another of the said cylinders, the columns of numbers being arranged alongside one another in a predetermined matrix.

Preferably the flexographic printing press is provided with three said table printing cylinders arranged to print three corresponding columns of numbers side-by-side, the number of numbers in each column corresponding to the multiple of the basic pitch value of the circumference of its respective cylinder.

Preferably each said table printing cylinder is arranged to print a plurality of spaced apart columns such that a plurality of tables are created across the width of the print material.

Preferably the flexographic press is provided with a further roller adapted to print silver coating over numbers printed by the table printing cylinders.

DESCRIPTION OF THE DRAWINGS

Notwithstanding any other forms that may fall within its scope, one preferred form of the invention will now be described by way of example only with reference to the accompanying drawings, in which.

DESCRIPTION OF THE PREFERRED EMBODIMENT

Figure 1:
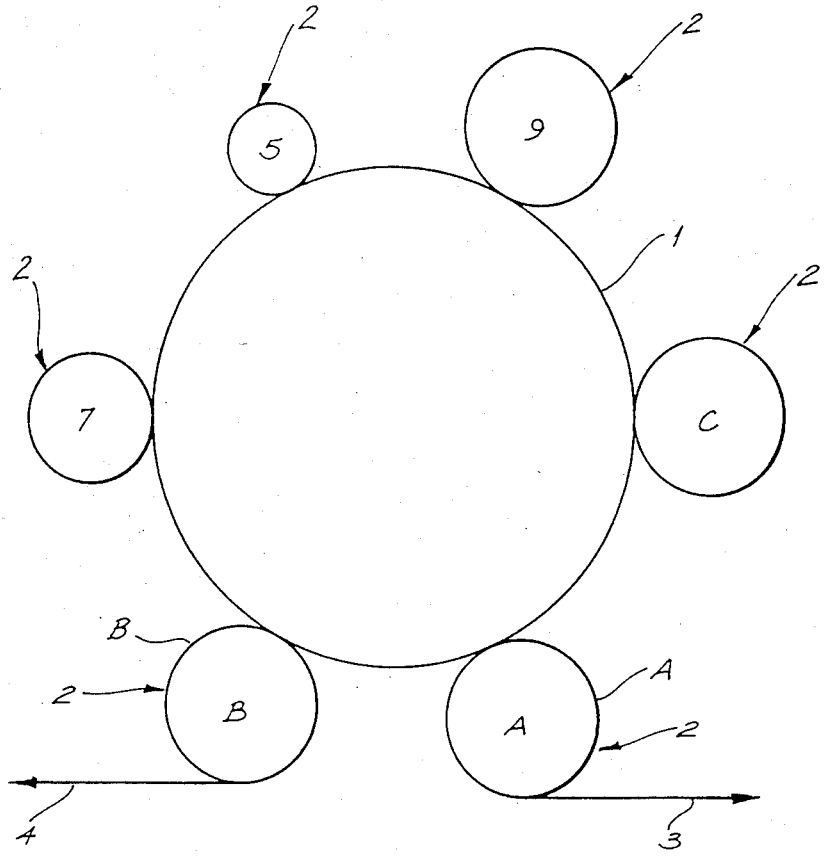
FIG. 1 is a diagrammatic end view of a flexographic printing press incorporating printing cylinders arranged according to the invention.

In the preferred form of the invention a flexographic printing press, for example a Victory Kidder Central Impression Press, is set up to print a series of quasi random number tables as follows.

The press comprises a central drum 1 around which is arrayed a plurality of printing cylinders 2 in the manner well known for use in, for example, a six-colour press. Each cylinder has a circumference determined by the role that it plays in printing the quasi random number tables, each circumference being a multiple of a basic pitch value. For convenience the cylinders are hereinafter referred to by reference numbers corresponding to the basic pitch value multiple which determines their circumference. It is preferred that the circumference of each cylinder is equal to the basic pitch value multiplied by a prime number as this gives the greatest number of variations before the printing pattern is repeated. The material, for example card, paper or plastic film packaging material, which is to be printed in the press is fed in as shown at 3 whereupon it wraps around the first cylinder A onto the drum 1, finally exiting by wrapping around the cylinder B and feeding off as shown at 4.

The first cylinder A is typically used to print a base colour for use under the scratch silver, and the second cylinder C may also be used for the printing of another base colour. The numbers in the quasi random number tables are printed by the table printing cylinders 9, 5 and 7 in a format as will be described further below. The final cylinder B is used to apply the scratch silver material over the numbers printed by the cylinders 9, 5 and 7.

The table printing cylinders 9, 5 and 7 are each of a different circumference which in each case is a multiple of a basic pitch value. For example cylinder 7 has a circumference of seven times the basic pitch value and is arranged to print a column of seven numbers arrayed around the circumference around the cylinder. It will be noted that the cylinder 5 and 7 have circumferences which are multiples of prime numbers (five and seven respectively) by the basic pitch value. The cylinder 9 has a circumference which is a multiple of three as this gives a convenient size, but a greater number of different repetitions could be obtained by giving this third cylinder a circumference which is, for example, eleven times the basic pitch value. One of the cylinders (in this case cylinder 9) may be the same circumference as the circumferences of the background and scratch silver printing cylinders A, B and C.

Figures 2, 3:
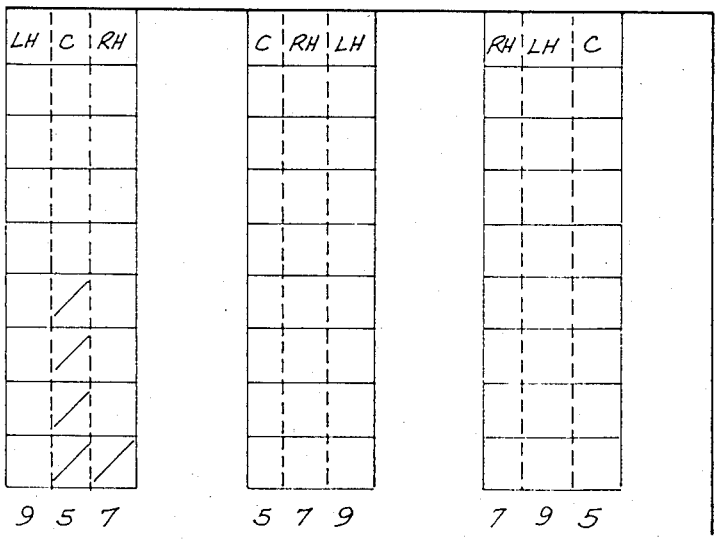
FIG. 2 is an example of a quasi random number table adapted to be printed by the apparatus shown in FIG. 1.
FIG. 3 is a diagrammatic view of the printing layout from three table printing cylinders.

In use the cylinders are used to print quasi random number tables of the type shown in FIG. 2 wherein each sub-rectangle 10 forms part of a matrix of similar rectangles or "numbers". In the case of the table shown in FIG. 2 the matrix is a 6×6 matrix. For convenience throughout this specification the contents of each sub-rectangle 10 is referred to as a "number" although it will be appreciated that the rectangle may contain more than one number and may alternatively contain other devices such as symbols, etc.

The numbers are printed onto the table using the table printing cylinders 9, 5 and 7 so that each cylinder prints every third column across the table. Explanation of this printing will now be made with reference to FIGS. 3, 4 and 5 which show the layout for a 9 column table (as distinct from the 6 column table shown in FIG. 2).

Referring now to FIG. 3 the 9 columns are shown broken down into three sub-sets of 3 columns, although in practice the 9 columns may be side-by-side in a continuous array. For convenience each column in each sub-set has been headed with the designations LH, C, or RH which refer to lefthand, centre and righthand respectively. At the foot of each column can be seen a numeral designating the cylinder which is used to print that column. It can be seen that cylinder 9 is used to print the lefthand column of the first sub-matrix, the centre column of the second sub-matrix and the righthand column of the third sub-matrix. As there are 9 rows in each repeat column shown in FIG. 3, it will be appreciated that cylinder 9 prints an entire column as shown in FIG. 3 during one rotation of that cylinder. As cylinder 5 has a much lesser circumference than cylinder 9 the columns which are printed by cylinder 5 involve one revolution of that cylinder for each five numbers printed in that respective column. Similarly with cylinder 7.

Figure 4:
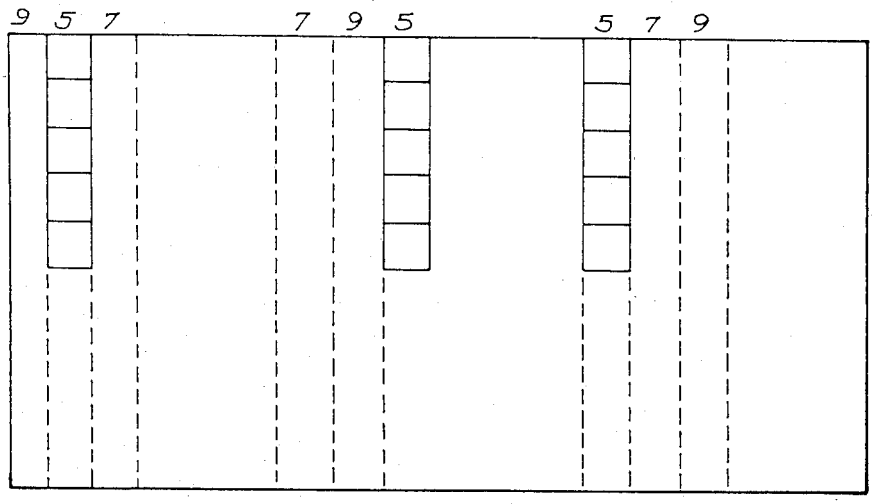
FIG. 4 is a diagrammatic layout showing the numbers printed by cylinder number 5 emphasised.

This may be seen more clearly with reference to FIG. 4 which shows highlighted the numbers (shown as rectangles) which are printed by cylinder 5 during one revolution of that cylinder. The continuing numbers in that particular column or columns are then printed by further rotations of cylinder 5. Similarly the numbers shown printed by cylinder 9 are highlighted in FIG. 5 wherein it can be seen that nine numbers in each column are printed by a single revolution of cylinder 9. As cylinder 9 is the same basic circumference as the background cylinders A, B and C it may also be used to print the game grid and other directions if required.

Figure 5:
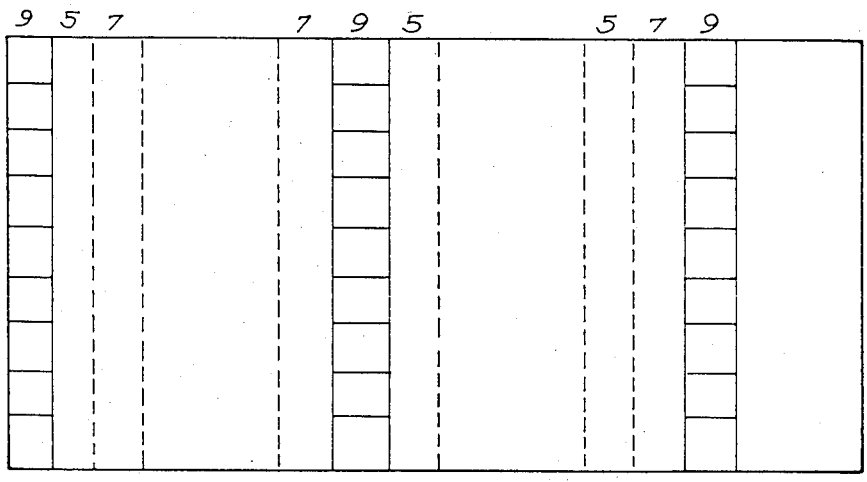
FIG. 5 is a diagrammatic layout similar to FIG. 4 with the numbers printed by cylinder number 9 emphasised.

It can be seen from an examination of FIGS. 3, 4 and 5 that the numbers printed alongside each other are "randomized" by the different number of revolutions of each table printing cylinder for each revolution of the drum 1. To further randomise the tables each cylinder is used to print a different column in each sub-matrix as can be seen in FIG. 3. By way of explanation, cylinder 9 could be used to print the lefthand column in each sub-matrix, etc. but a higher degree of randomisation is achieved by using cylinder 9 to print different columns in each sub-matrix.

In this manner it is possible to print a large number of quasi random number tables before the basic combination is repeated. The basic combination is, however, repeated at predetermined intervals and may in the examples shown in FIGS. 3, 4 and 5, repeat on every 315th game panel in a printing run. In this manner it is possible to arrange the numbers on each cylinder so that a winning combination is printed on every 315th game panel. These "latent winners" may be used to designate minor (low value) prizes so that the originator of the game may activate a winning combination in every 315th game. Major prize winners are normally hand printed and interleaved and collated within the losing or "latent winner" combinations printed by the method described above.

It is therefore possible according to the invention to print quasi random number tables particularly suitable for scratch bingo or other lottery type games in a single print run using the apparatus described above and resulting in considerable savings in man handling and time.

What I claim is:

1. Apparatus for printing quasi-random number tables (as herein defined) comprising a flexographic printing press having at least two table printing cylinders arrayed about a central drum, said table printing cylinders having different circumferences, the circumference of each cylinder being a multiple of a basic pitch value, each one of the table printing cylinders being arranged to print at least one column of numbers incorporating a predetermined number of numbers therein different from the number of numbers printed in a column by another of the said cylinders, the columns of numbers being arranged alongside one another in a predetermined matrix.

2. Apparatus for printing quasi-random number tables as claimed in claim 1 wherein three said table printing cylinders are provided arranged to print three corresponding columns of numbers side-by-side, the number of numbers in each column corresponding to the multiple of the basic pitch value of the circumference of its respective cylinder.

3. Apparatus for printing quasi-random number tables as claimed in claim 1 wherein the circumference of each cylinder is equal to the basic pitch value multiplied by a prime number.

4. Apparatus for printing quasi-random number tables as claimed in claim 1 wherein each said table printing cylinder is arranged to print a plurality of spaced apart columns such that a plurality of tables are created across the width of the print material.

5. Apparatus for printing quasi-random number tables as claimed in claim 1 wherein the flexographic press is provided with a further roller adapted to print a removable coating over numbers printed by the table printing cylinders.

* * * * *